United States Patent [19]

Gillette et al.

[11] Patent Number: 4,519,507

[45] Date of Patent: May 28, 1985

[54] APPARATUS FOR SEPARATING TACKS FROM SURVEILLANCE TAGS

[75] Inventors: Dennis Gillette, Ft. Lauderdale; David Gentzler, Boynton, both of Fla.

[73] Assignee: Sensormatic Electronics Corporation, Deerfield Beach, Fla.

[21] Appl. No.: 441,657

[22] Filed: Nov. 15, 1982

[51] Int. Cl.[3] ..... B07C 5/12

[52] U.S. Cl. ..... 209/682; 209/630; 209/707

[58] Field of Search ..... 209/629, 630, 632–634, 209/659, 660, 677, 680, 682, 691, 696, 707, 933, 940, 539, 352, 544

[56] References Cited

U.S. PATENT DOCUMENTS

| | | | |
|---|---|---|---|
| 3,455,445 | 7/1969 | Allen et al. | 209/682 |
| 3,506,118 | 4/1970 | Illuzzi | 209/680 |
| 3,784,007 | 1/1974 | Skrmetta | 209/682 |
| 3,977,525 | 8/1976 | Lamborn | 209/682 |

FOREIGN PATENT DOCUMENTS

| | | | |
|---|---|---|---|
| 13827 | 6/1890 | Fed. Rep. of Germany | 209/682 |
| 1441632 | 5/1966 | France | 209/682 |

*Primary Examiner*—Robert B. Reeves
*Assistant Examiner*—Donald T. Hajec
*Attorney, Agent, or Firm*—Robin Blecker & Daley

[57] ABSTRACT

A bi-level ramp supported under a table with an access slot has a plurality of laterally spaced longitudinal ribs providing a series of channels on the upper level for supporting and extracting surveillance tags while the channels contain a plurality of spaced apertures for passing tacks to the lower level for separated discharge into respective receptacles.

8 Claims, 11 Drawing Figures

10
11
12
20
21
22
23
24
25
26
27
29
30
32
34
35
36
37
38
39
40
41
43
44
46
47

APPARATUS FOR SEPARATING TACKS FROM SURVEILLANCE TAGS

BACKGROUND OF THE INVENTION

The present invention relates to sorting apparatus for sorting parts of an article surveillance system.

Surveillance systems are presently in use in retail stores and the like wherein a tag is secured to each article of merchandise which tag contains an element detectable by a portal unit for activating an alarm if the tag is not removed by authorized personnel upon purchase of the item involved. One type of tag unit incorporates the detectable element in a housing that is secured to the article by means of a tack having a head and a shank, the shank being passed through the article and fastened in a clutch lock in the housing. The usual procedure in a retail outlet is to provide the cashier with a tool for separating the tack from the tag whereupon the parts are dumped into a container for subsequent sorting and re-use. It is the sorting that has heretofore posed a problem, which problem it is the intent of the present invention to solve. The reason for sorting is related, of course, to economy of time and efficiency in reapplying the tags to a large inventory of incoming merchandise.

SUMMARY OF THE INVENTION

In accordance with the invention there is provided apparatus for use with a quantity of article surveillance tags and unattached tacks in random mixture for separating said tacks from said tags where said tacks have a head and a shank and are used to fasten said tags to fabric, or the like, said apparatus comprising a bi-level ramp having an upper level a predetermined height above a lower level, means for suspending said ramp beneath a work surface having an opening for introducing said mixed quantity of tags and tacks to one end of said ramp, said one end of said ramp being elevated relative to its other end, said other end being supported above a support surface such that a pair of receptacles can be disposed beneath said other end in position to receive articles traversing the respective levels of said ramp, a plurality of apertures in the upper level of said bi-level ramp larger than the greatest dimensions of said tacks for freely permitting a tack to pass through said upper level of said ramp to the lower level of said ramp, said suspending means being constructed to support said ramp with a sufficient inclination to cause tacks to slide along the upper level until they pass through one of said apertures and to continue to slide along the lower level to an outlet from which they are guided into any underlying receptacle, means for elevating above the surface of said upper level of said ramp a majority of those tags that are introduced to the top of said ramp while slidingly conveying said tags down the ramp to a second outlet for deposit in any underlying receptacle, said tag elevating means being constructed to permit substantially unimpeded movement of said tacks along said upper level toward said apertures.

BRIEF DESCRIPTION OF THE DRAWINGS

The invention will be better understood after reading the following detailed description of the presently preferred embodiments thereof with reference to the appended drawings in which:

FIG. 5 is a perspective view of a tag;

The same reference numerals are used throughout the drawings to designate the same or similar parts.

DETAILED DESCRIPTION OF THE PRESENTLY PREFERRED EMBODIMENT

Figures 2, 3, 4:
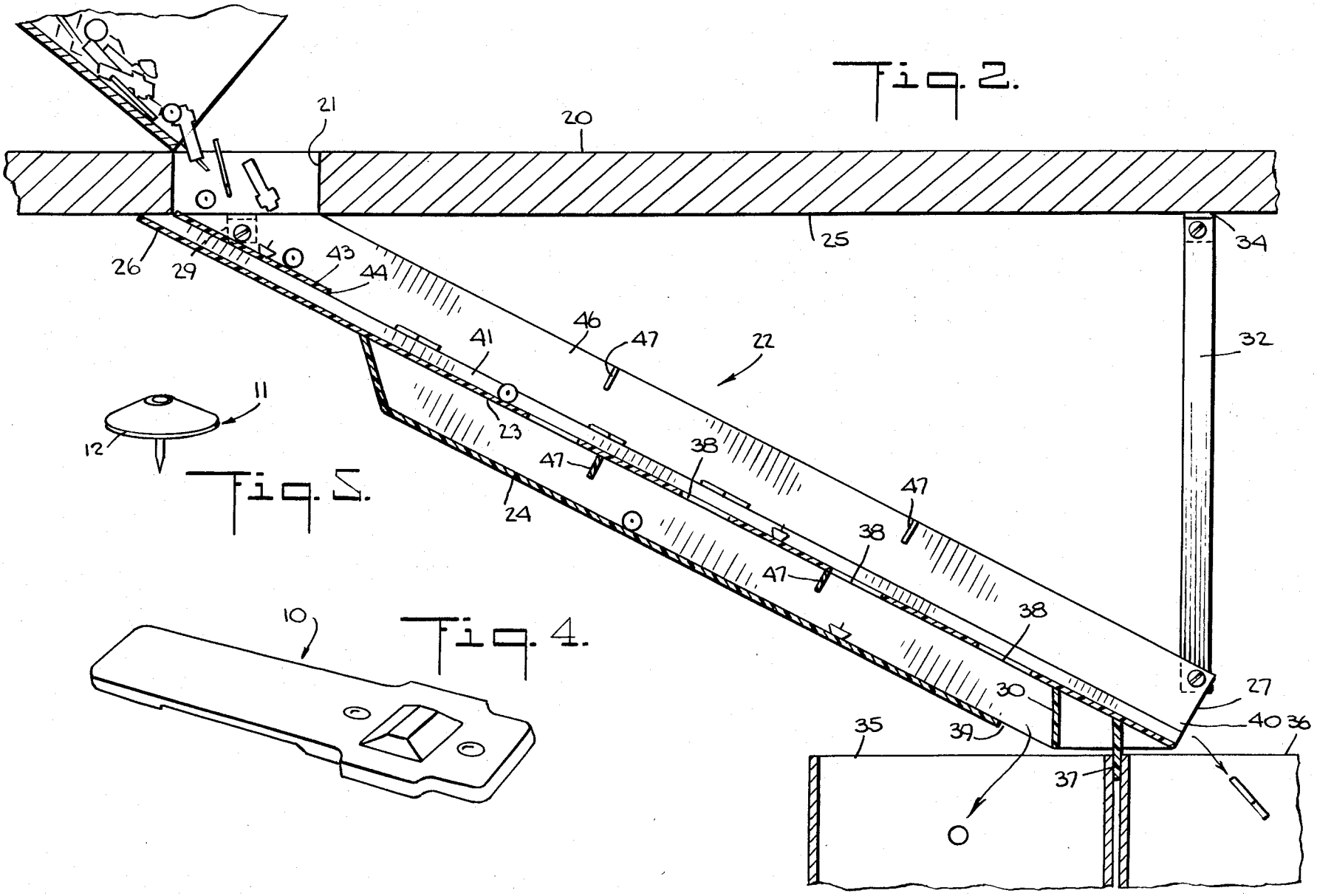
FIG. 2 is a vertical longitudinal sectional view taken along line 2—2 in FIG. 1.
FIG. 3 is a top plan view of the sorting ramp in relation to the receiving receptacles.
FIG. 4 is a perspective view of a tack.
Figure 3:
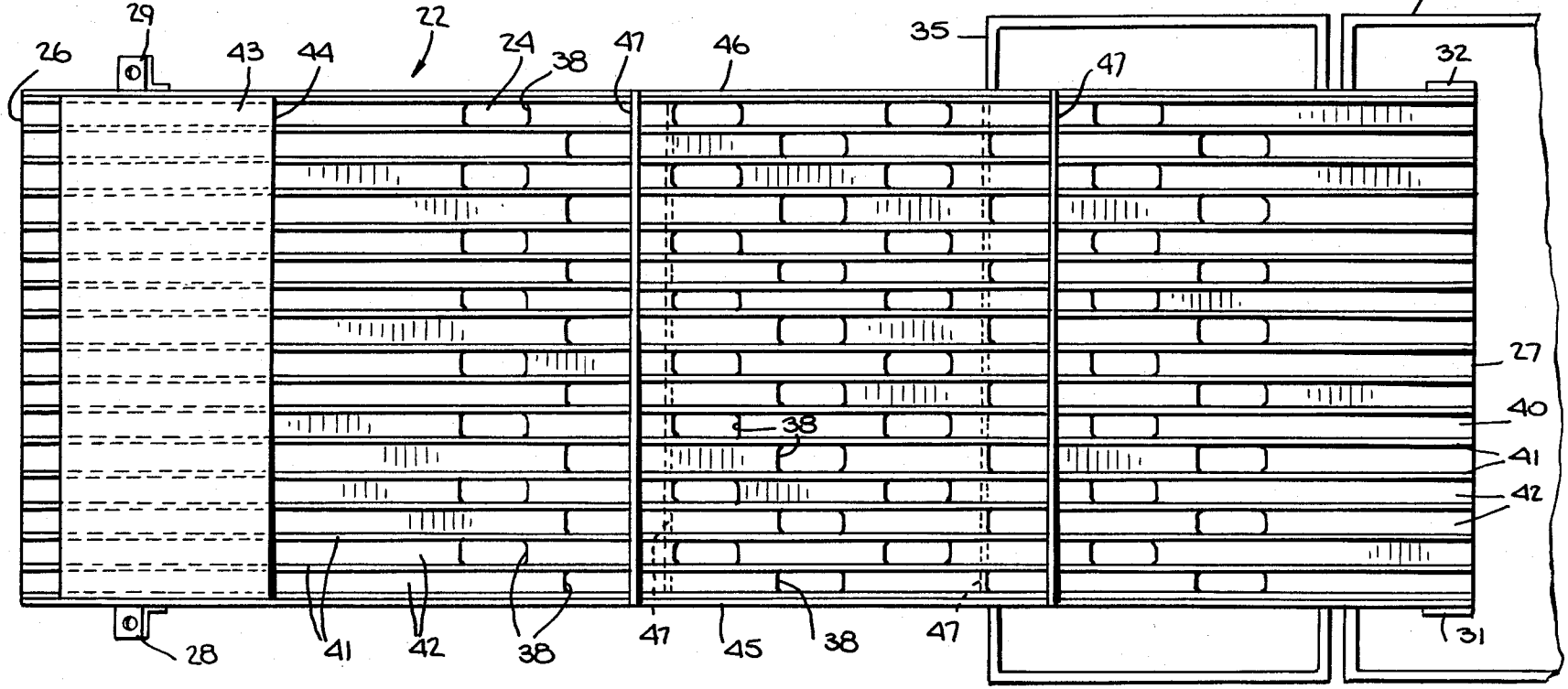

Referring first to FIG. 4, there is shown merely by way of example a single tag 10 and, in FIG. 5, a tack 11 that would be among many others in a random mixture in a carton or other container awaiting sorting. While forming no part of the present invention, details of the tag 10 can be found in U.S. Pat. No. 4,299,870 of David R. Humble, issued Nov. 10, 1981, and assigned to the same assignee as the present invention. The tag 10 of this application consists of the arm 53 from the embodiment illustrated in FIGS. 15, 16 and 17 of said Humble patent. The tack, although not shown in said patent, has a shank corresponding to the pin 52 in FIGS. 15 and 16 of said patent, and has a head 12 substantially as shown in the present application drawings. Assembly to an article involves piercing some part thereof with the tack shank and introducing the point into the aperture (not shown) on the underside of the tag in FIG. 4 providing access to a concealed clutch lock.

As will appear from the ensuing description, the sorter is not limited to use with any one specific type tack or tag. Thus the tag can be patterned after housing 11 in FIG. 6 of U.S. Pat. No. 3,942,829, issued Mar. 9, 1976, to Humble et al. and also assigned to the same assignee.

Figure 1:
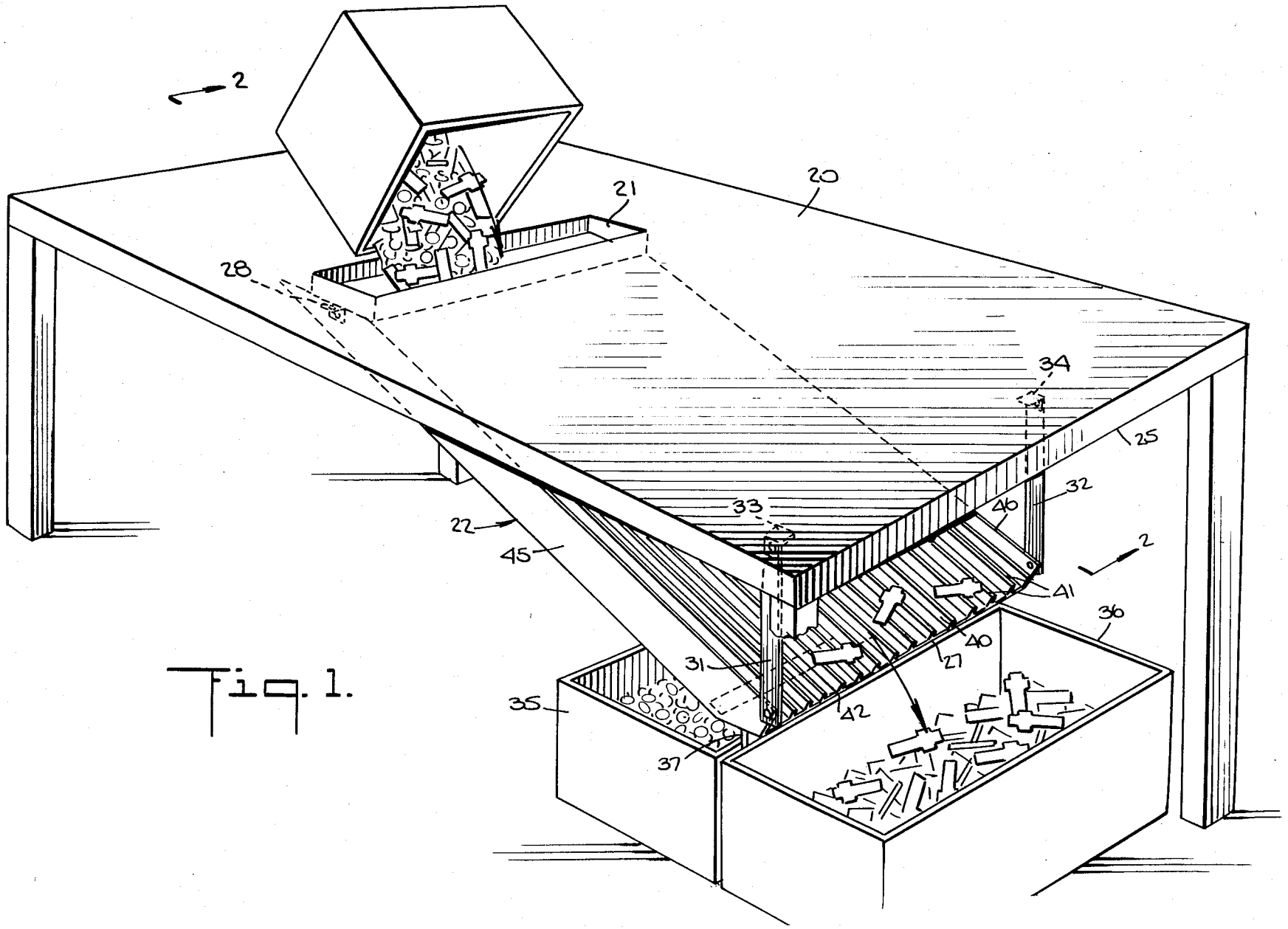
FIG. 1 is a perspective view of a work table provided with a sorting ramp in accordance with the invention and showing its manner of use.

Referring now to FIGS. 1, 2 and 3 of the drawings, there is shown at 20 a typical work surface in the form of a table, or the like, having at one end a generally rectangular cutout or opening 21 through which a load of mixed tags and tacks can be dumped. Beneath the table 20 there is suspended a ramp 22 of bi-level construction, best seen in FIG. 2, having an upper level 23 and a lower level 24. The ramp 22 is secured to the underside 25 of the table 20 with the end 26 elevated relative to the end 27. The end 26 is secured to the underside 25 of table 20 in contact therewith beneath opening 21 by means of a pair of angle brackets 28 and 29 (best seen in FIG. 3). The opposite end 27 is suspended by support straps 31 and 32, also fastened by angle brackets, 33 and 34, to underside 25.

The support straps 31 and 32 should be proportioned to support the ramp 22 with a sufficient inclination to cause tacks and tags to slide down the ramp in the manner described below. In addition, the ramp end 27 should be positioned above the floor or other support surface such that a pair of receptacles 35 and 36 can be disposed beneath the end 27 in position to receive articles traversing the respective levels of the ramp. As shown, the receptacles 35 and 36 are positioned one on each side of a locator tab or strip 37 that extends below the end 27 of ramp 22.

The upper level 23 of the ramp 22 is provided with a plurality of apertures 38, larger than the greatest dimensions of a tack 11, for freely permitting a tack to pass through the upper level 23 to the lower level 24 (see FIGS. 6, 7, 8 and 9). Once on the lower level 24, a tack 11 will slide or roll along the lower level to an outlet 39 from which it is guided by an end stop 30 into the underlying receptacle 35. As best seen in FIG. 3, the apertures 38 are in line parallel to the longitudinal direction or axis of the ramp 22 and are staggered in adjacent lines to avoid undue weakening of the upper level 23 of the ramp.

In order to facilitate separation of the tags 10 from the tacks 11 there is provided means for elevating above the surface of the upper level 23 of ramp 22 a majority of those tags 10 that are introduced to the top 26 of the ramp while slidingly conveying the tags 10 down the ramp to another outlet, in this case the open end of the upper level 23 at 40. The means for elevating the tags 10 comprise a series of parallel ribs 41 extending parallel to the longitudinal direction of the ramp 22 and normal to the surface of upper level 23, the ribs 41 being spaced laterally from one another to provide a series of channels 42 for guiding tacks 11 toward apertures 38.

Figure 6:
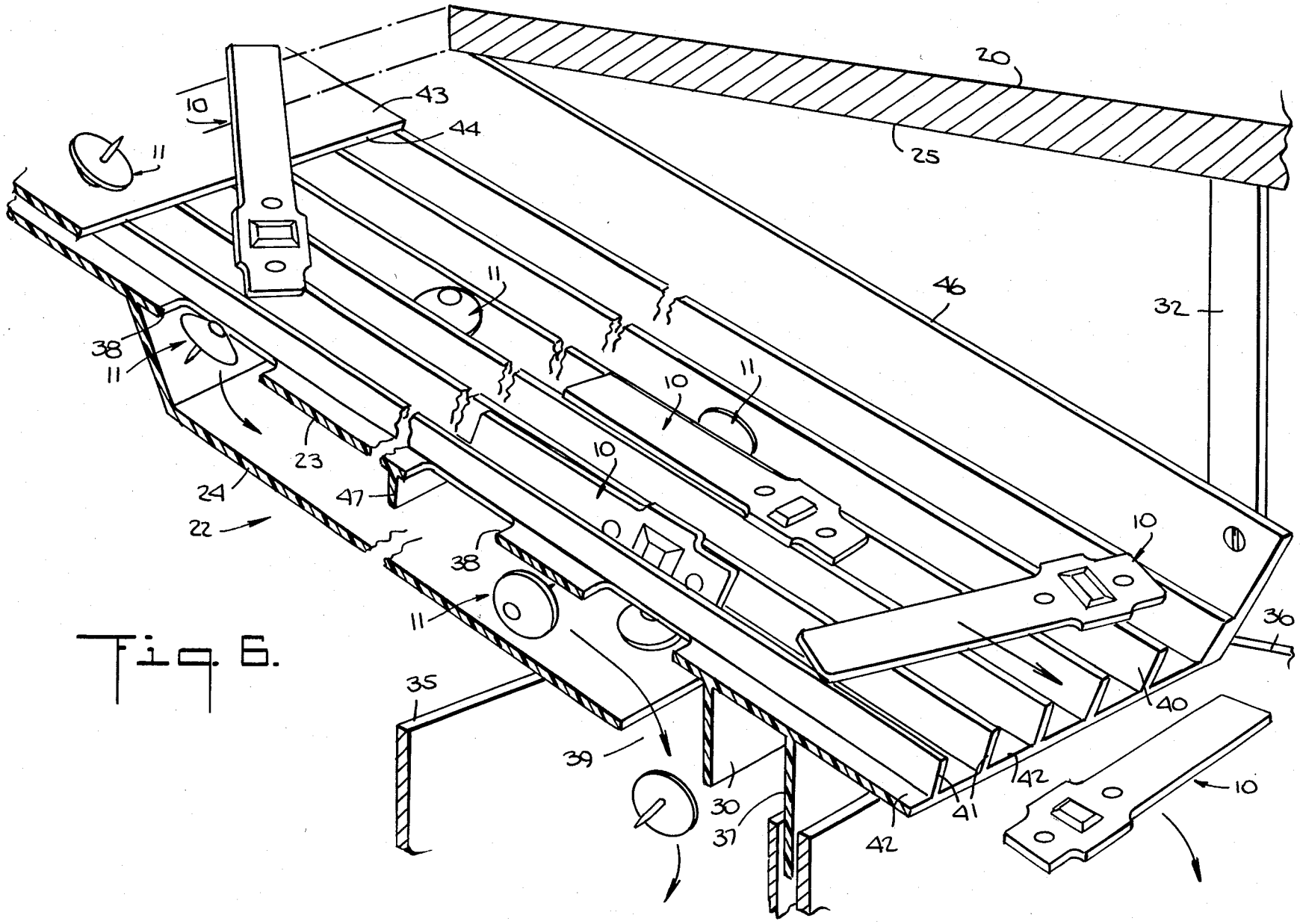
FIG. 6 is an enlarged, partially truncated, partially broken away perspective view of the sorter ramp illustrating various aspects of the sorting operation and the sundry movements of pieces along the apparatus.
Figure 7:
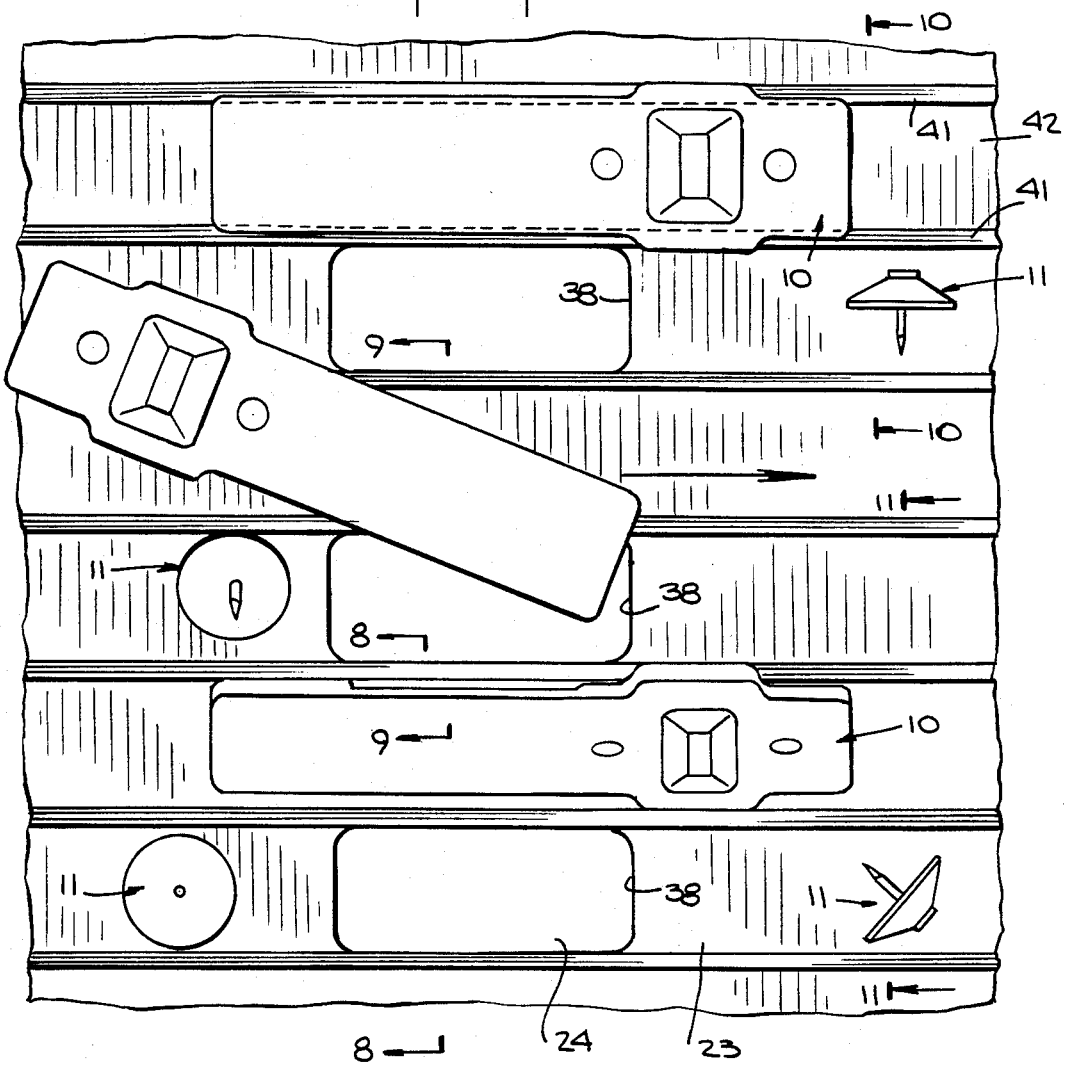
FIG. 7 is a fragmentary top plan view, enlarged relative to FIG. 3, and showing tags and tacks in various conditions of movement along the sorter ramp.
Figure 8:
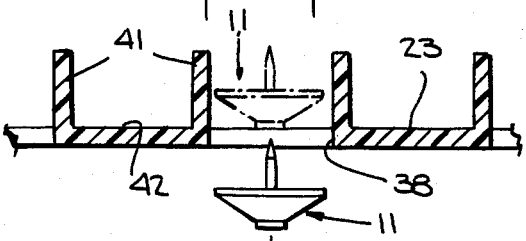
FIG. 8 is a sectional elevational view taken along line 8—8 in FIG. 7.
Figure 10:
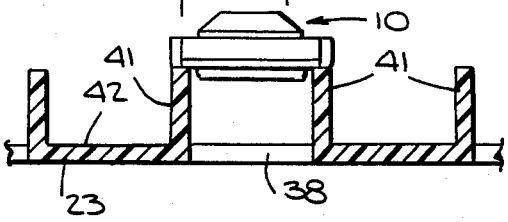
FIG. 10 is a sectional elevational view taken along line 10—10 in FIG. 7.
Figure 9:
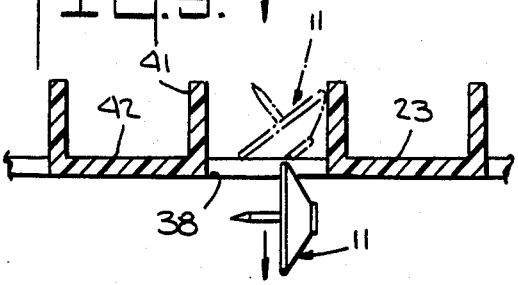
FIG. 9 is a sectional elevational view taken along line 9—9 in FIG. 7.
Figure 11:
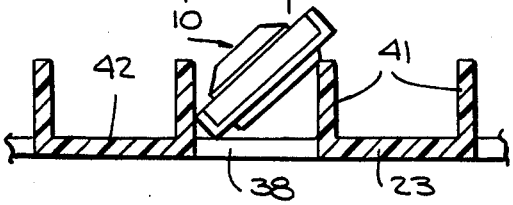
FIG. 11 is a sectional elevational view taken along line 11—11 in FIG. 7.

As seen in FIGS. 3 and 6, the apertures 38 are of generally rectangular configuration coinciding with and as wide as the channels 42 and about $2\frac{1}{2}$ times as long as they are wide. For sorting tacks the overall dimensions of which fit within a cube approximately $\frac{3}{4}''$ on a side, it has been found that slots 38 approximately $13/16'' \times 2''$, spaced in the longitudinal direction about 4" apart, are satisfactory. This is for a ramp inclination of about 28°.

While the tags 10 are small enough in cross-section to pass through an aperture 38, complete passage is barred by limiting the ceiling height between upper level 23 and lower level 24 of ramp 22. In the described example such height is about 2" and this has proven adequate with tags a little over 4" long and about 1" wide. Because the tags are wider than the width of apertures 38, the tags can penetrate only when canted which aids in barring total passage through the apertures 38. Assuming that all the tacks 11 fall through apertures 38 to the lower level 24, it becomes a simple matter of removing by hand the few tags 10 that might become hung up in the apertures. Also, it has been found that with the ramp inclined at about 28° and with a tag 10 slightly more than twice as long as the length of apertures 38, the tags tend to ride over the apertures even though they might become aligned with and fall partially into a channel 42. Because the width of the channel is less than the width of a tag the tag can not fall flat into a channel but is constrained to slide down the ramp in a canted position. See FIGS. 6, 7, 10 and 11.

It has been found advantageous to provide a cover 43 over the ribs 41 at the upper end 26 of the ramp 22 which cover occupies the area that is intended to be located below the opening 21 in the work surface 20. The opening 21 is preferably only slightly wider than the longest tag to be sorted, and the cover 43 should be wide enough to prevent direct vertical access to the channels 42 from the opening 21. Thus, the cover 43 will cause tags and tacks deposited through opening 21 to be deflected and accelerated down the ramp 22 such that the tags 10 tend to ride along the upper edges of ribs 41 (see FIGS. 6, 7 and 10) while the tacks 11 drop into the channels 42 for passage through an aperture 38 (see FIGS. 6, 7, 8 and 9).

To further minimize the likelihood of a tag 10 entering an aperture 38, the first transverse row of apertures is preferably located at least a tag's length beyond the edge 44 of cover 43.

The ramp levels 23 and 24 are structurally integrated by side rails 45 and 46 and a series of cross braces 47. A satisfactory embodiment has been constructed from sheets of ABS plastic which manifests sufficient strength while minimizing the coefficient of friction relative to the tags and tacks.

While rectangular tags 10 have been illustrated and described, it should be evident that any shape tag can be sorted so long as there exists a significant difference in size as between tag and tack.

Having described the invention with reference to a presently preferred embodiment thereof, it is to be understood that numerous changes in construction, configuration and dimension can be introduced to adapt the sorter to tags of different size and shape, all without departing from the true spirit of the invention as defined in the appended claims.

What is claimed is:

1. Apparatus for use with a quantity of article surveillance tags and unattached tacks in random mixture for separating said tacks from said tags where said tacks have a head and a shank and are used to fasten said tags to fabric, or the like, and said tags have at least one principal dimension that is larger than the largest dimension of said tacks, said apparatus comprising a bi-level ramp having an upper level a predetermined height above a lower level, means for suspending said ramp beneath a work surface having an opening for introducing said mixed quantity of tags and tacks to one end of said ramp, said one end of said ramp being elevated relative to its other end, said other end being supported above a support surface such that a pair of receptacles can be disposed beneath said other end in position to receive articles traversing the respective levels of said ramp, a plurality of apertures in the upper level of said bi-level ramp larger than the greatest dimension of said tacks for freely permitting a tack to pass through said upper level of said ramp to the lower level of said ramp, said apertures being sized and shaped such that said tags can, for a selected orientation, and in the absence of any other impediment, pass therethrough, said predetermined height between said lower and upper level of said ramp being insufficient to permit complete ingress of a tag, said suspending means being constructed to support said ramp with a sufficient inclination to cause tacks to slide along the upper level until they pass through one of said apertures and to continue to slide along the lower level to an outlet from which they are guided into any receptacle underlying said outlet, and means for elevating above the surface of said upper level of said ramp a majority of those tags that are introduced to the top of said ramp while slidingly conveying said tags down the ramp to a second outlet for deposit in any receptacle underlying said second outlet, said tag elevating means being constructed to permit substantially unimpeded movement of said tacks along said upper level toward said apertures.

2. Apparatus according to claim 1, characterized in that said plurality of apertures are distributed in a series of parallel lines extending parallel to the longitudinal direction of said ramp, the apertures in adjacent lines being staggered so as to avoid undue weakening of the upper level of said ramp.

3. Apparatus according to claim 1, characterized in that said means for elevating tags above the surface of said upper level of said ramp comprise a series of parallel ribs extending parallel to the longitudinal direction of said ramp and normal to the surface of said upper level of said ramp, said ribs being spaced laterally from one another to provide a series of channels for guiding said tacks toward said apertures.

4. Apparatus according to claim 3, characterized in that said plurality of apertures are distributed in a series of parallel lines coinciding with said channels, the apertures in adjacent lines being staggered so as to avoid undue weakening of the upper level of said ramp.

5. Apparatus according to claim 4, characterized in that said one end of the ramp is provided with a cover over said ribs occupying the area for location below said opening in the work surface, said cover causing tags and tacks deposited through said work surface opening to be deflected and accelerated down the ramp such that the tags tend to ride along the upper edges of said ribs while said tacks drop into said channels for passage through an aperture to said lower level.

6. Apparatus according to claim 3, characterized in that said one end of the ramp is provided with a cover over said ribs occupying the area for location below said opening in the work surface, said cover causing tags and tacks deposited through said work surface opening to be deflected and accelerated down the ramp such that the tags tend to ride along the upper edges of said ribs while said tacks drop into said channels for passage through an aperture to said lower level.

7. Apparatus for use with a quantity of article surveillance tags and unattached tacks in random mixture for separating said tacks from said tags where said tacks have a head and a shank and are used to fasten said tags to fabric, or the like, and said tags have at least one principal dimension that is larger than the largest dimension of said tacks, said apparatus comprising a bi-level ramp having an upper level a predetermined height above a lower level, means for suspending said ramp beneath a work surface having an opening for introducing said mixed quantity of tags and tacks to one end of said ramp, said one end of said ramp being elevated relative to its other end, said other end being supported above a support surface such that a pair of receptacles can be disposed beneath said other end in position to receive articles traversing the respective levels of said ramp, a plurality of apertures in the upper level of said bi-level ramp larger than the greatest dimension of said tacks for freely permitting a tack to pass through said upper level of said ramp to the lower level of said ramp, said suspending means being constructed to support said ramp with a sufficient inclination to cause tacks to slide along the upper level until they pass through one of said apertures and to continue to slide along the lower level to an outlet from which they are guided into any receptacle underlying said outlet, and a series of parallel ribs extending parallel to the longitudinal direction of said ramp and normal to the surface of said upper level of said ramp for elevating above the surface of said upper level of said ramp a majority of those tags that are introduced to the top of said ramp while slidingly conveying said tags down the ramp to a second outlet for deposit in any receptacle underlying said second outlet, said ribs being spaced laterally from one another to provide a series of channels for guiding and permitting substantially unimpeded movement of said tacks along said upper level toward said apertures, said one end of the ramp being provided with a cover over said ribs occupying the area of location below said opening in the work surface, said cover causing tags and tacks deposited through said work surface opening to be deflected and accelerated down the ramp such that the tags tend to ride along the upper edges of said ribs while said tacks drop into said channels for passage through an aperture to said lower level.

8. Apparatus according to clam 7, characterized in that said plurality of apertures are distributed in a series of parallel lines coinciding with said channels, the apertures in adjacent lines being staggered so as to avoid undue weakening of the upper level of said ramp.

* * * * *